United States Patent [19]

Nielsen

[11] Patent Number: 4,622,786

[45] Date of Patent: Nov. 18, 1986

[54] COMPOSITE WINDOW FOR ATTIC APARTMENTS

[75] Inventor: Per G. Nielsen, Horsens, Denmark

[73] Assignee: V. Kann Rasmussen Holding A/S, Søborg, Denmark

[21] Appl. No.: 775,512

[22] PCT Filed: Jan. 11, 1985

[86] PCT No.: PCT/DK85/00001

§ 371 Date: Aug. 12, 1985

§ 102(e) Date: Aug. 12, 1985

[87] PCT Pub. No.: WO85/03100

PCT Pub. Date: Jul. 18, 1985

[30] Foreign Application Priority Data

Jan. 13, 1984 [DK] Denmark ..... 153/84

[51] Int. Cl.[4] ..... E04D 13/02; E04D 13/14; E06B 1/34

[52] U.S. Cl. ..... 52/58; 52/72; 52/200

[58] Field of Search ..... 52/58, 200, 201, 72

[56] References Cited

U.S. PATENT DOCUMENTS

| | | | |
|---|---|---|---|
| 1,898,813 | 2/1933 | Carlson | 52/72 |
| 2,602,968 | 7/1952 | Simon | 52/90 X |
| 2,875,710 | 3/1959 | Bechtold | 52/58 X |
| 3,253,857 | 5/1966 | Deisenroth | 52/72 |
| 3,399,500 | 9/1968 | Shapiro | 52/200 X |
| 3,754,536 | 12/1973 | Fleming . | |
| 4,327,532 | 5/1982 | Matthews | 52/200 X |

FOREIGN PATENT DOCUMENTS

| | | | |
|---|---|---|---|
| 1166443 | 3/1964 | Fed. Rep. of Germany | 200/ |
| 2142733 | 3/1973 | Fed. Rep. of Germany | 52/200 |
| 2321773 | 11/1973 | Fed. Rep. of Germany . | |
| 561264 | 8/1923 | France | 52/90 |
| 78097128 | 8/1980 | Sweden . | |
| 780187 | 7/1957 | United Kingdom | 52/201 |

OTHER PUBLICATIONS

"AB Swenska Icopalfabriken, SVITA Takfonster," pub. by Huvudkontor.

"Monteringsvejledning . . . ," pub. by Per Gudmann Nielsen, 1982.

*Primary Examiner*—Alfred C. Perham

*Attorney, Agent, or Firm*—Lane & Aitken

[57] ABSTRACT

In a composite window comprising a skylight component and a wall component, the top member (4) of the frame of the wall component presents an upstanding ridge (7) which engages a groove (9), triangular in cross-section, in the bottom member (8) of the skylight frame so as to tiltably support the skylight component. On their outer faces the frame members (4,8) are weather protected by a covering including an angular gusset plate (13) being in overlapping relationship with two covering members (10,12) mounted on the frame top member (4) and the frame bottom member (8), respectively, the angle and the overlapping of said gusset plate (13) being adjustable dependent on the angle between the frames (2, 3) of the wall and skylight components, respectively.

1 Claim, 1 Drawing Figure

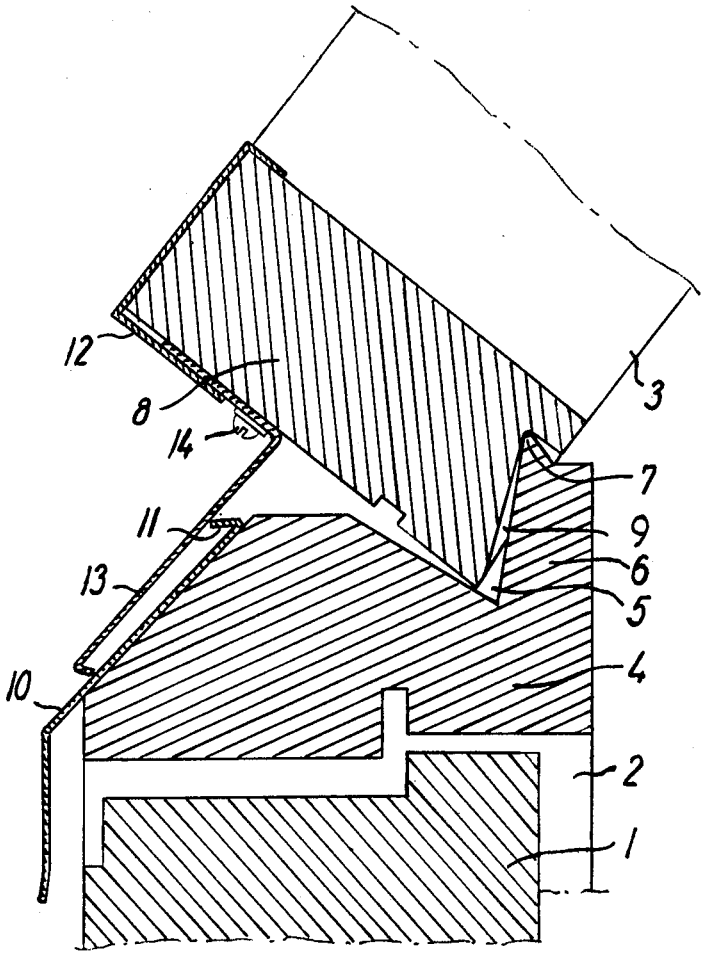
12
8
14
11
13
10
3
7
9
6
5
4
2
1

COMPOSITE WINDOW FOR ATTIC APARTMENTS

BACKGROUND OF THE INVENTION

The invention relates to a composite window intended for attic apartments and comprising a skylight component adapted for inclined installation and a wall component, said components having separate frames including a bottom member and a top member, respectively, adapted to be united with one another in the area of the eaves of the roof, the window further comprising a prefabricated outer covering on the united frame members.

Generally, such windows provide a better daylight effect in the room and a better outlook than ordinary overhead windows and are therefore used to an increasing extent.

The skylight and wall components can be produced according to standards and be installed independently, except that they must be united adjacent the eaves by means of a length of spacing wood having a triangular cross section, the angles of which must fit to the actual inclination of the roof, which in practice may vary between about 20° and 80°. This length of triangular wood may be finally shaped at the working place or site, but in order to ensure the right quality and shape it should be supplied by the window manufacturer, and the same applies to the covering, the cross sectional shape and dimensions of which may differ essentially from one window to another, especially dependent on the inclination of the roof. Thus, this inclination must be known to the window manufacturer in order that the purchaser's expectations with respect to the quality of the finished window may be fulfilled. In other words, the supplied goods must include certain tailored elements which complicate the production and shipping and increase the costs thereof.

The same holds true to an even higher degree in case of specially made windows in which the bottom member of the skylight frame and the top member of the frame of the wall component are formed by an integrated element because the cross-sectional configuration of this element must conform to the inclination of the roof.

On this basis, a purpose of the invention is to provide a window belonging to the type specified in the foregoing but which, contrary to the known embodiments, may be standardized in all details and yet may be used by all roof inclinations met in practice.

SUMMARY OF THE INVENTION

According to the invention this is achieved in the way that the bottom member of the frame of the skylight component rests on the top member of the frame of the wall component so as to be tiltable on a horizontal axis, and that the covering includes an angular gusset plate having a first flange, which abuts the lower surface of the bottom member of the skylight frame and is overlapped by a covering member thereon, and a second flange which displaceably overlaps a covering member mounted on the top member of the frame of the wall component.

After installation of the wall component of the window in its correct position, the skylight component due to its tiltable support thereon may be adjusted to the inclination of the roof and be fixed thereto, and the necessary adaptation of the covering with respect to its cross-sectional configuration and dimension is obtained so-to-speak automatically, viz. by variation of the angle of the gusset plate, normally a reduction thereof, and of its overlapping relationship with the other covering members.

Thus, the window according to the invention may be manufactured and delivered as a fully standardized product without regard to the inclination of the roof in which it shall be installed and without requiring complicated adaptation measures in connection with its installation.

BRIEF DESCRIPTION OF THE DRAWING

The invention is illustrated on the drawing which shows a vertical section of the window portions located substantially in the area of the eaves on the place of installation.

DESCRIPTION OF THE PREFERRED EMBODIMENT

The drawing shows the top portion of a vertical wall window with a sash 1 and a frame 2, and the bottom portion of a skylight comprising a frame 3 and a sash, not shown. These window components may be of a well-known type and are not shown in details.

In contrast to ordinary practice, the top frame member 4 of the wall component is provided with a groove 5 which towards the inner face of the window is bounded by an upstanding part 6 topped by a triangular ridge 7, and in the inner face of the bottom member 8 of the skylight frame 3 a corresponding triangular groove 9 is provided, the bottom angle of which is substantially greater than the top angle of the ridge 7 so that the inclination of the skylight frame 3 supported by the vertical frame 2 may be adjusted within reasonably wide limits.

A covering member 10 is secured to the outer chamferred face of the top member 4 of the frame of the wall component of the window, said covering member 10 forming a so-called snow barrier 11 at its upper edge, and a further covering member 12 protects the outer face and part of the bottom face of the skylight frame bottom member 8. A third covering member is constituted by an angular gusset plate 13 comprising a first flange which overlaps the first covering member 10, and a second flange which extends upwardly between the frame bottom member 8 and the covering member 12 thereof and is fastened against said bottom member by means of screws 14. Initially, the angle of the gusset plate 13 may be substantially greater than shown on the drawing so that it is appropriately reduced by the insertion of the screw thereby also causing the lower edge of the gusset plate 13 to be displaced upwardly along the covering member 10 on the frame top member 4.

I claim:

1. A composite window intended for attic apartments and comprising a skylight component adapted for inclined installation and a wall component, said components having separate frames including a bottom member and a top member, respectively, adapted to be united with one another in the area of the eaves of a roof, the window further comprising a prefabricated outer covering on the united frame members, wherein the bottom member of the frame of the skylight component rests on the top member of the frame of the wall component so as to be tiltable on a horizontal axis, and that the covering includes an angular gusset plate having a first flange which abuts the lower surface of the bottom member of the skylight frame and is overlapped by a covering member thereon, and a second flange which displaceably overlaps a covering member mounted on the top member of the frame of the wall component, and further wherein, in its inner face, the bottom member of the skylight frame presents a groove of triangular cross-sectional configuration and with the bottom of this groove riding on the top edge of a ridge on the frame top member of the wall component of the window, said ridge being also triangular in cross-section and having a top angle that is substantially smaller than a bottom angle of the groove.

* * * * *